US009776784B2

(12) United States Patent
DeJesus

(10) Patent No.: US 9,776,784 B2
(45) **Date of Patent: *Oct. 3, 2017**

(54) PACKAGING SYSTEM AND METHOD

(71) Applicant: THIRD DIMENSION, INC., Geneva, OH (US)

(72) Inventor: Louis G. DeJesus, Geneva, OH (US)

(73) Assignee: Third Dimension, Inc., Geneva, OH (US)

( * ) Notice: Subject to any disclaimer, the term of this patent is extended or adjusted under 35 U.S.C. 154(b) by 586 days.

This patent is subject to a terminal disclaimer.

(21) Appl. No.: 14/305,861

(22) Filed: Jun. 16, 2014

(65) Prior Publication Data

US 2014/0291195 A1 Oct. 2, 2014

Related U.S. Application Data

(63) Continuation of application No. 12/406,436, filed on Mar. 18, 2009, now Pat. No. 8,752,703.

(51) Int. Cl.

| | |
|---|---|
| ***B65D 81/107*** | (2006.01) |
| ***B65D 81/133*** | (2006.01) |
| ***B65B 55/20*** | (2006.01) |
| ***B65D 81/113*** | (2006.01) |
| ***B65D 81/127*** | (2006.01) |
| ***B65D 85/30*** | (2006.01) |
| ***B65D 85/48*** | (2006.01) |
| ***B65B 23/20*** | (2006.01) |

(52) U.S. Cl.

CPC ..... *B65D 81/133* (2013.01); *B65B 23/20* (2013.01); *B65B 55/20* (2013.01); *B65D 81/113* (2013.01); *B65D 81/1275* (2013.01); *B65D 85/307* (2013.01); *B65D 85/48* (2013.01)

(58) Field of Classification Search

CPC B65D 81/113; B65D 81/1275; B65D 81/133; B65D 85/307; B65D 85/48

USPC ..... 206/523, 583, 586, 806, 592, 453

See application file for complete search history.

(56) References Cited

U.S. PATENT DOCUMENTS

| | | | | |
|---|---|---|---|---|
| 3,339,722 A * | 9/1967 | Van Antwerpen | ..... | B65D 85/48 206/453 |
| 4,240,240 A | 12/1980 | Cohen | | |
| 4,241,832 A * | 12/1980 | Bliss | ..... | B65D 81/05 206/523 |

(Continued)

OTHER PUBLICATIONS

International Search Report for International Application No. PCT/US2010/027817 dated May 26, 2010.

*Primary Examiner* — King M Chu

(74) *Attorney, Agent, or Firm* — Ward Law Office LLC; Jacob M. Ward

(57) ABSTRACT

A packaging system and method for securing a product within a shipping container includes providing a shipping container appropriately sized for the product, attaching at least a first shock absorption member to the shipping container for serving as a locator for the product and for positioning the product on the shipping container. Attaching at least a second shock absorption member to the shipping container for, together with the at least a first shock absorption member, securing the product on the shipping container. The shipping container is closed about the product, which is itself suspended by the at least a first shock absorption member and the at least a second shock absorption member.

11 Claims, 7 Drawing Sheets

(56) References Cited

U.S. PATENT DOCUMENTS

| | | | | |
|---|---|---|---|---|
| 4,339,039 | A * | 7/1982 | Mykleby | B65D 81/107 206/523 |
| 4,443,508 | A | 4/1984 | Mehl | |
| 4,750,609 | A | 6/1988 | Felis | |
| 5,328,156 | A | 7/1994 | Hoke | |
| 7,296,681 | B2 | 11/2007 | McDonald et al. | |
| 2006/0196136 | A1 | 9/2006 | Karl | |
| 2008/0029423 | A1 | 2/2008 | Davlin | |
| 2008/0173555 | A1 | 7/2008 | Horiuchi | |
| 2009/0249752 | A1 | 10/2009 | DiMauro | |
| 2011/0149490 | A1 | 6/2011 | Seo | |
| 2014/0290186 | A1 | 10/2014 | DeJesus | |
| 2014/0291195 | A1 | 10/2014 | DeJesus | |
| 2014/0353199 | A1 | 12/2014 | DeJesus | |

* cited by examiner

PACKAGING SYSTEM AND METHOD

RELATED APPLICATIONS

This is a continuation of Ser. No. 12/406,436 filed Mar. 18, 2009 and now U.S. Pat. No. 8,752,703.

BACKGROUND

The present disclosure relates to a packaging system and method, and more particularly relates to an improved packaging system and method for shipping and handling of all types of doors, glass doors, doors with glass inserts, mirrors, framed art, etc.

Protective packaging is often used to protect products or articles from shocks and impacts during shipping or transportation. For example, when transporting articles that are relatively fragile and/or valuable, it is often desirable to cushion the article inside a box to protect the article from a physical impact with the inner walls of the box that might be caused by shocks imparted to the box during loading, transit, unloading, etc.

Often times, some additional structure is used to keep the article from moving uncontrollably within the box. Such additional structures can include paper or plastic packaging materials, structured plastic foams, foam-filled cushions, and the like. In some instances, the article to be packaged is suspended within the box so as to be spaced from at least some of the walls of the box, thus protecting the article from other foreign objects which may impact or compromise the outer walls of the box.

Items or articles that are sometimes shipped in this manner include doors, such as cabinet doors, which can be formed of glass or with glass inserts, mirrors, framed art, etc. One prior art shipping container includes a relatively thin rectangular box which receives the suspended shipping item between a pair of large foam sheets. Frame members can be disposed along upper and lower ends of the box and/or right and left side ends of the box. Typically the box requires the application of an adhesive, such as glue, at multiple locations to secure the box in a closed position with the product to be shipped interposed between the foam sheets within an opening defined by the frame members.

A major drawback of this type of shipping arrangement is the cost of materials required for each item to be shipped. Other drawbacks include increased shipping weight due to the large foam sheets and the frame members. Also, the item being shipped is prone to movement or migration within the box, particularly migration toward one of the ends (e.g., upper or lower ends) of the box. This can be reduced or eliminated by exact sizing of the box, the frame members and the foam sheets to correspond to the item being shipped, but then a large inventory of boxes, frame members and foam sheets is required to accommodate varying sizes of items being shipped.

SUMMARY

According to one aspect, an improved packaging method is provided for a product. More particularly, in accordance with this aspect, a shipping container appropriately sized for the product is provided. At least one shock absorption member is attached to the shipping container for serving as a locator for the product relative to the shipping container. The product is positioned on the shipping container with the at least one shock absorption member. At least another shock absorption member is attached to the shipping container to secure the product on the shipping container. The shipping container is closed about the product with the shock absorption members suspending the product within the enclosed shipping container.

According to another aspect, an improved packaging system is provided for a product. More particularly, and in accordance with this aspect, the packaging system includes a shipping container appropriately sized for the product and at least a first shock absorption member attached to the shipping container for serving as a locator for the product and for positioning the product on the shipping container. The packaging system further includes at least a second shock absorption member attached to the shipping container for, together with the at least a first shock absorption member, securing the product on the shipping container. The product is suspended by the at least a first shock absorption member and the at least a second shock absorption member within the shipping container when the shipping container is closed about the product for shipping.

According to still another aspect, an improved packaging method is provided for securing a product within a shipping container. More particularly, in accordance with this aspect, a first shock absorption clip is attached to the shipping container for positioning the product relative to the shipping container. The product is installed onto the shipping container. A second shock absorption clip is attached to the shipping container for securing the product relative to the shipping container. The shipping container is assembled about the product with the first and second shock absorption clips suspending the product within the shipping container.

DETAILED DESCRIPTION

Figure 1:
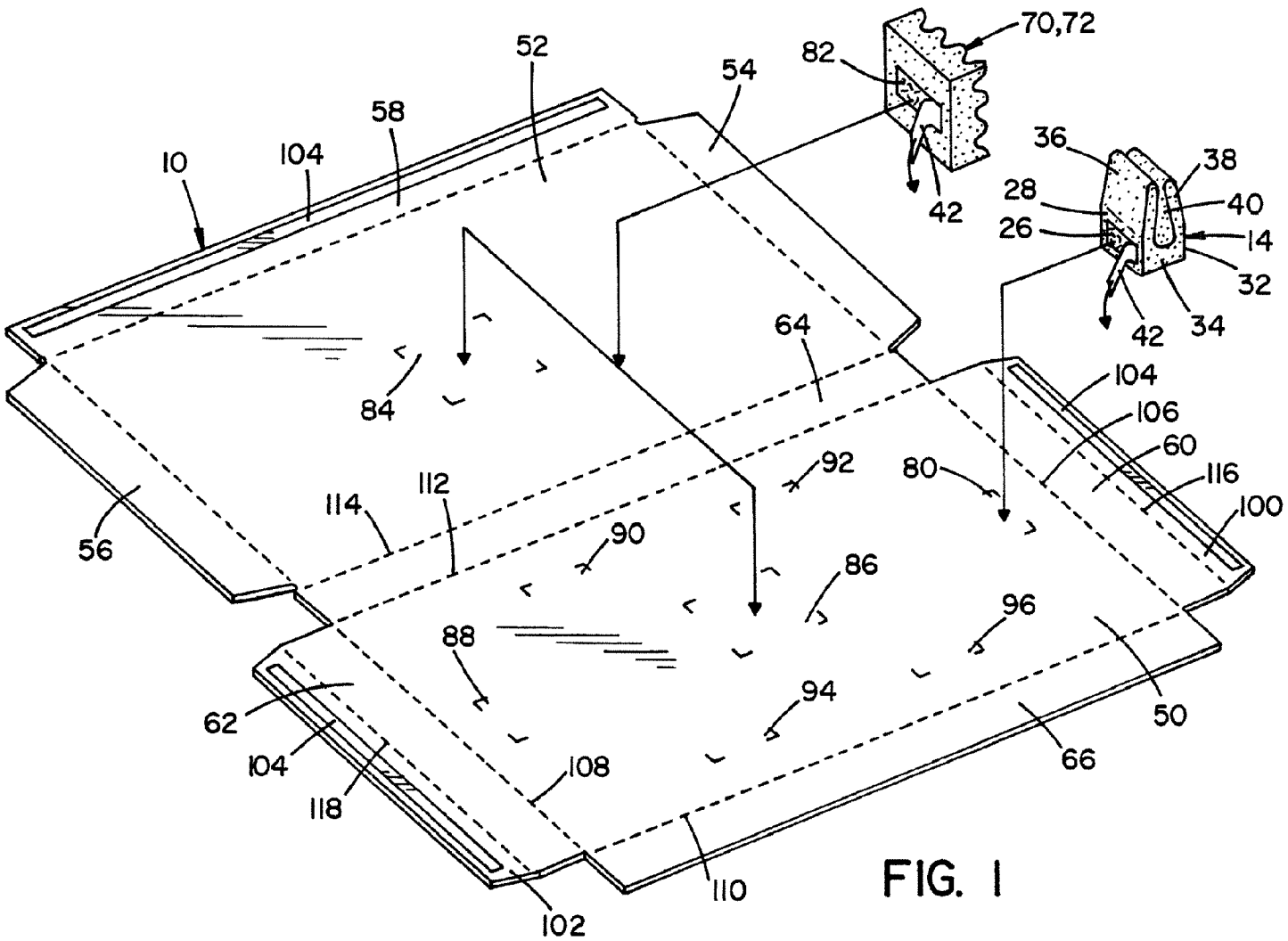
FIG. 1 is perspective view of a shipping container prior to folding showing a shock absorption member and one or more foam pads being attached to the shipping container.

Referring now to the drawings, wherein the showing are for purposes of illustrating one or more exemplary embodiments, FIGS. 1-6 illustrate a packaging system for a product, such as a door or a cabinet door, which can include a glass portion or insert, or alternatively the product can be a mirror, framed art, etc. The packaging system includes a shipping container 10, which can be appropriately sized for the product that it is to be shipped (e.g., cabinet door 12 shown in FIGS. 3-6). The packaging system further includes at least a first shock absorption clip or member, such as shock absorption clip or member 14, attached to the shipping container 10 for serving as a locator for the product 12 and for positioning the product 12 on the shipping container 10. In addition, the packaging system includes at least a second shock absorption clip or member (e.g., shock absorption member 16) that is attached to the shipping container 10 for, together with the at least a first shock absorption member, securing the product 12 on the shipping container 10.

Figure 6:
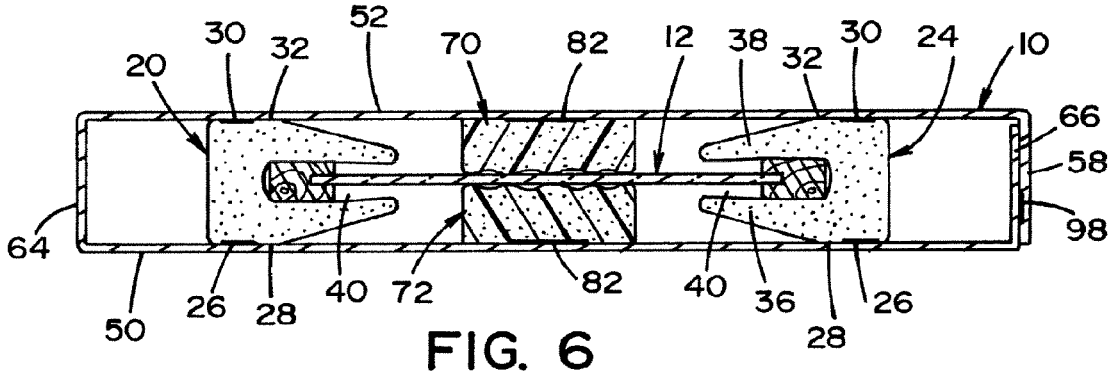
FIG. 6 is a cross-sectional view of the shipping container taken through the line 6-6 of FIG. 5.

In the illustrated embodiment, shock absorption member 14 is alone attached to the shipping container 10 for serving as the locator for the product 12 and for positioning the product 12 on the shipping container 10, and shock absorption member 16, along with shock absorption clips or members 18,20,22,24, are attached to the shipping container 10 for securing the products 12 on the shipping container 10 together with the shock absorption member 14. That is, the shock absorption member 14 locates and positions the product 12 on the shipping container 10, while all of the illustrated shock absorption members 14-24 secure the product 12 on the shipping container 10. It will be appreciated by those skilled in the art that more than a single shock absorption member, such as member 14, can be used for locating the product 12 on the shipping container 10 and for positioning the product 12 on the shipping container 10. Likewise, the number of shock absorption members securing the product 12 on the shipping container 10 can vary from the illustrated embodiment (e.g., more or fewer shock absorption members can be used to secure the product 12 on the shipping container 10). As will be described in more detail below, and as best illustrated in FIG. 6, the product 12 (a cabinet door in the illustrated embodiment) is suspended by the shock absorption members 14-24 within the shipping container 10 when the shipping container is closed about the product 12 for shipping.

Figure 7:
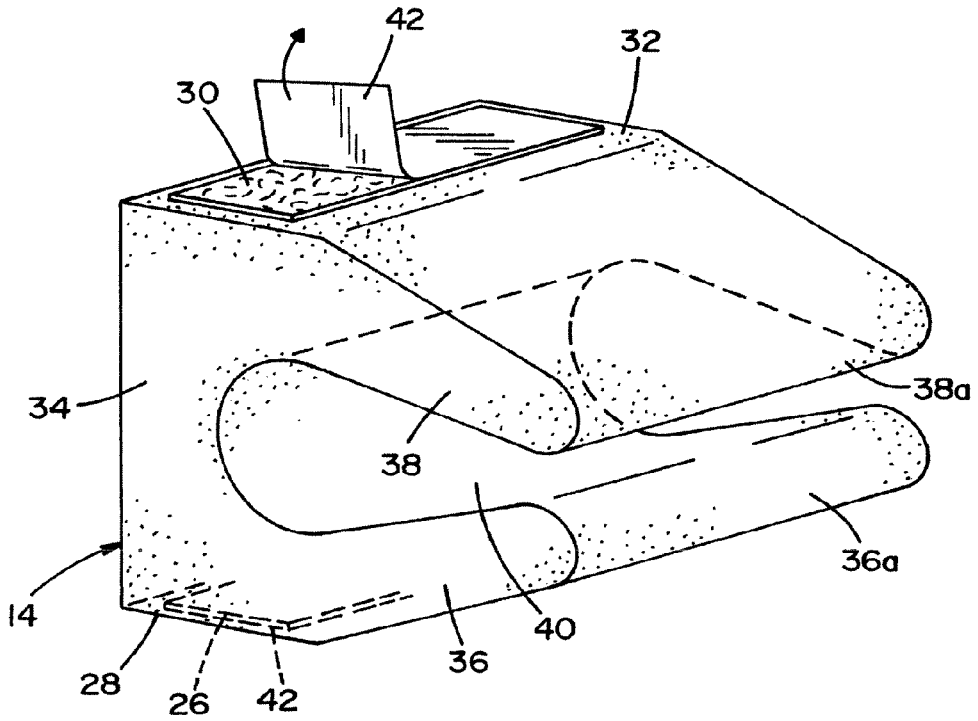
FIG. 7 is a perspective view of one of the shock absorption members.

The shock absorption members 14-24 can be extruded polyethylene, though other materials could also be used. Structurally, all the shock absorption members can be similarly constructed; accordingly, only shock absorption member 14 will be described in further detail herein, but its description is applicable to the other shock absorption members 16-24. The shock absorption member 14 is attached to the shipping container by at least one adhesive strip. More specifically, and with specific reference to FIG. 7, the shock absorption member 14 includes a first adhesive strip 26 disposed on a first side 28 and a second adhesive strip 30 disposed on a second, opposite side 32.

As shown, the shock absorption member 14 includes a base wall 34 and a pair of clamping walls 36,38 extending from spaced apart locations of the base wall 34 to form a slot 40 therebetween and into which the product 12 can be received for securement thereof. In the illustrated shock absorption member 14, the clamping walls 36,38 converged toward one another as the walls 36,38 extend away from the base wall 34. That is, the slot 40 defined between the converging walls 36,38 is wider adjacent the base wall 34 than adjacent distal ends 36*a*,38*a* of the converging walls. The first side 28 on which the first adhesive strip 26 is provided is defined by the clamping wall 36. Likewise, the second side 32 to which the second adhesive strip 30 is attached is defined by the clamping wall 38. As will be described in further detail below, the first adhesive strip 26 on the first side 28 allows the shock absorption member 14 to be attached to the shipping container 10, whereas the second adhesive strip 30 on the second side 32 allows the shipping container 10 to be attached to the shock absorption member 14 when the shipping container is folded into a box about the product 12. Each of the adhesive strips 26,30 can have a peelable liner 42 disposed thereon to prevent the adhesive strips from inadvertently adhering to an undesirable object and/or location.

Figure 8:
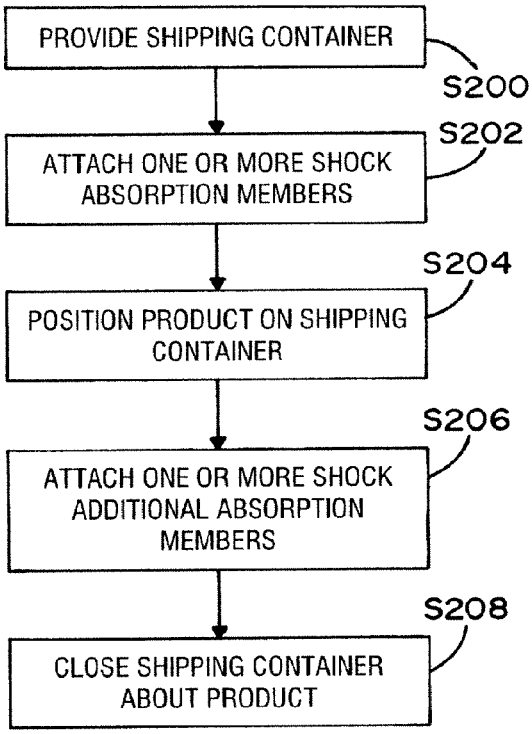
FIG. 8 is a block diagram illustrating a packaging method.

With additional reference to FIG. 8, a packaging method for a product, and particularly for securing a product within a shipping container, will now be described. In step S200, a shipping container, such as shipping container 10 is provided. Shipping container 10 can be appropriately sized for the product that is to be shipped thereby. For example, the illustrated shipping container 10 is sized relative to the illustrated product 12 so that the product 12 is fully received within the shipping container 10 when in its folded state shown in FIGS. 5 and 6. Unlike some prior art packaging systems and shipping containers, the shipping container 10 may not be exactly sized relative to the product to be shipped therein. Accordingly, a few shipping containers 10 of varying sizes can be maintained in inventory to ship a variety of product sizes. In one embodiment, the shipping container 10 is a cardboard box container, and optionally can be formed by 100% recycled materials, though this is not required.

As best shown in FIG. 1, the shipping container 10 can be formed from a single sheet of material. In particular, the shipping container 10 can include a first main section 50, which will be disposed adjacent one side of the product 12, and a second main section 52, which will be disposed adjacent a second side of the product 12. The second section 52 can include end tabs 54,56 and side tab 58. The tabs 54,56,58 can be separated from the main section 52 by fold lines, score lines or the like as is known and understood by those skilled in the art. The first main section can similarly include end tabs 60,62 and side tabs 64,66. These tabs 60-66 can be separated from the first main section 50 by fold lines, score lines or the like. As will be described in further detail below, the end tabs 60,62 are configured to overlap the end tabs 54,56 when the shipping container 10 is folded about the product 12. In this manner, the tabs 54,60 will form a first end of the shipping container 10 and the tabs 56,62 will form a second end of the shipping container 10. The tab 64 will form a first side end of the shipping container 10 and the tabs 58,66 together will form a second side end of the shipping container 10.

The next step (S202) in the packaging method is to attach at least one or a first shock absorption member to the shipping container 10 for serving as a locator for the product 12 relative to the shipping container 10. In the illustrated embodiment, as shown in FIG. 1, step S202 specifically includes attachment of the shock absorption member 14 to the shipping container at location 80 for positioning the product 12 relative to the shipping container 10. It is to be appreciated that additional shock absorption members, such as any one or more of illustrated shock absorption members 16-24, or some other shock absorption member(s), could also be attached to the shipping container 10 in step S202 for serving as locators for the product 12 relative the shipping container 10, if desired.

In addition to attaching to shock absorption member 14 to the shipping container 10, one or more foam pads can be attached to the shipping container 10. Specifically, as shown in the illustrated embodiment, foam pads 70,72 can be respectively attached at locations 84,86 to the first and second main sections 50,52, which respectively form first and second sides of the box when the shipping container 10 is folded into its box form. As will be described in more detail below, the foam pads 70,72 are positioned or interposed between the sides 50,52 of the shipping container 10 and the product 12 carried within the shipping container 10. The foam pad 70,72 can be formed by polyester foam, though this is not required.

Figure 2:
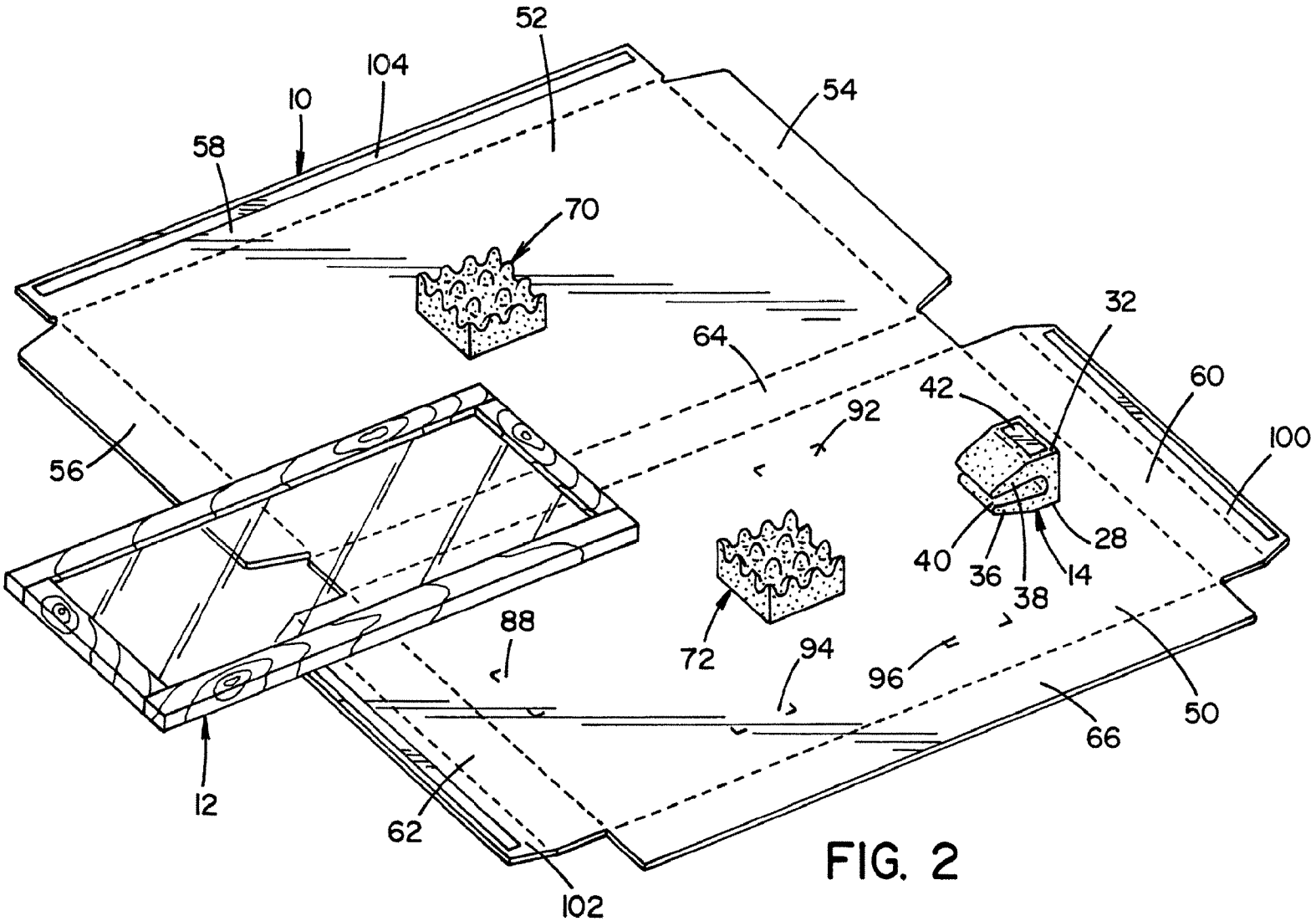
FIG. 2 is a perspective view of the shipping container of FIG. 1, showing a product, such as a cabinet door with a glass insert, being positioned on the shipping container by receipt of one edge of the product within a slot defined by the shock absorption member.

Next, with reference to FIG. 2, the product 12 can be positioned or installed in step S204 on or onto the shipping container 10 with or by the at least one shock absorption member (e.g., member 14) that was attached to the shipping container 10 in step S202. Positioning or installing the product 12 on the shipping container 10 in step S204 includes inserting the product 12 into the slot 40 defined by the shock absorption member 14 (or slots of each shock absorption member if multiple shock absorbers are applied in step S202).

Figure 3:
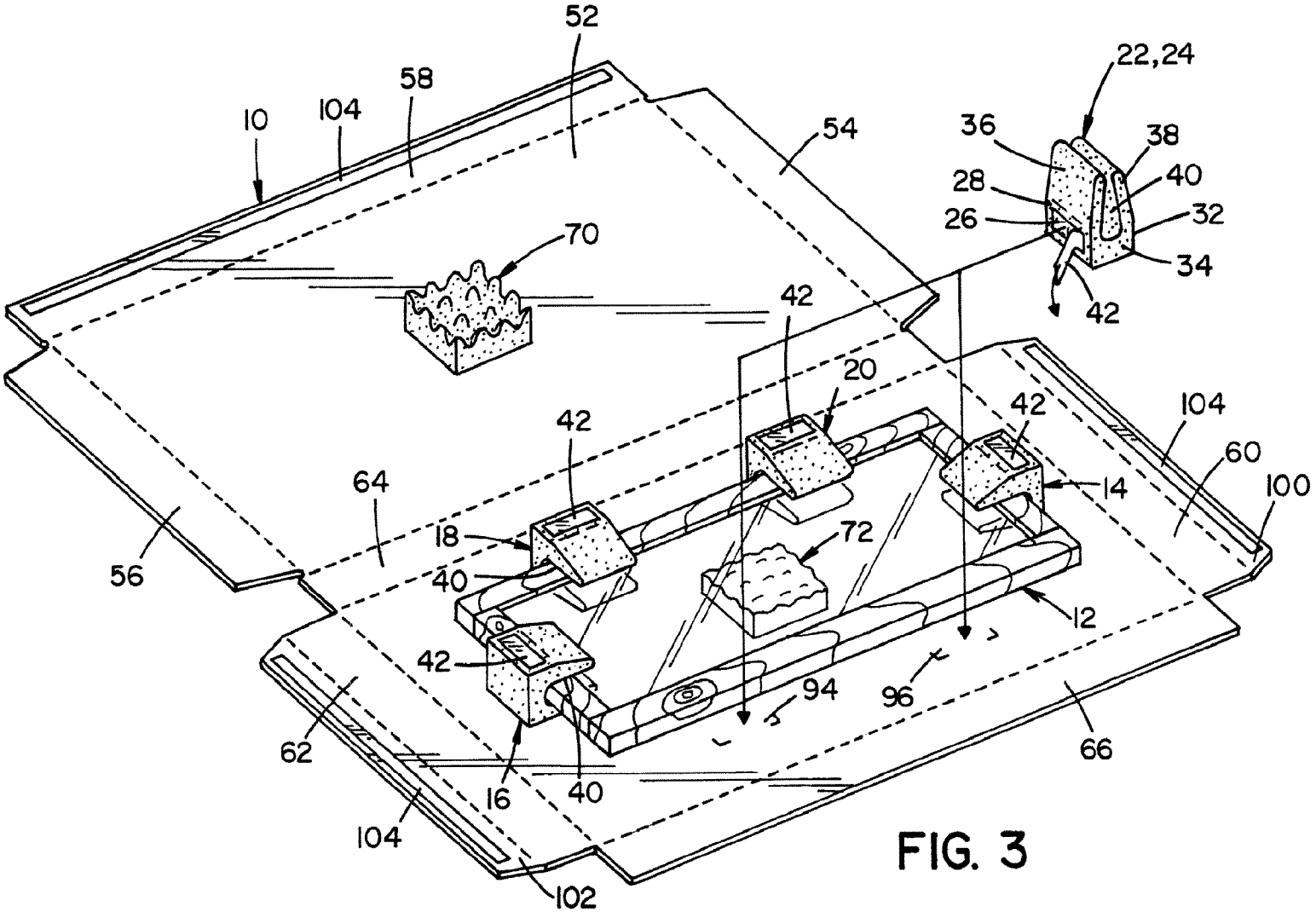
FIG. 3 is perspective view of the shipping container of FIG. 2 showing additional shock absorption members being attached to the shipping container to secure the product thereon.
Figure 4:
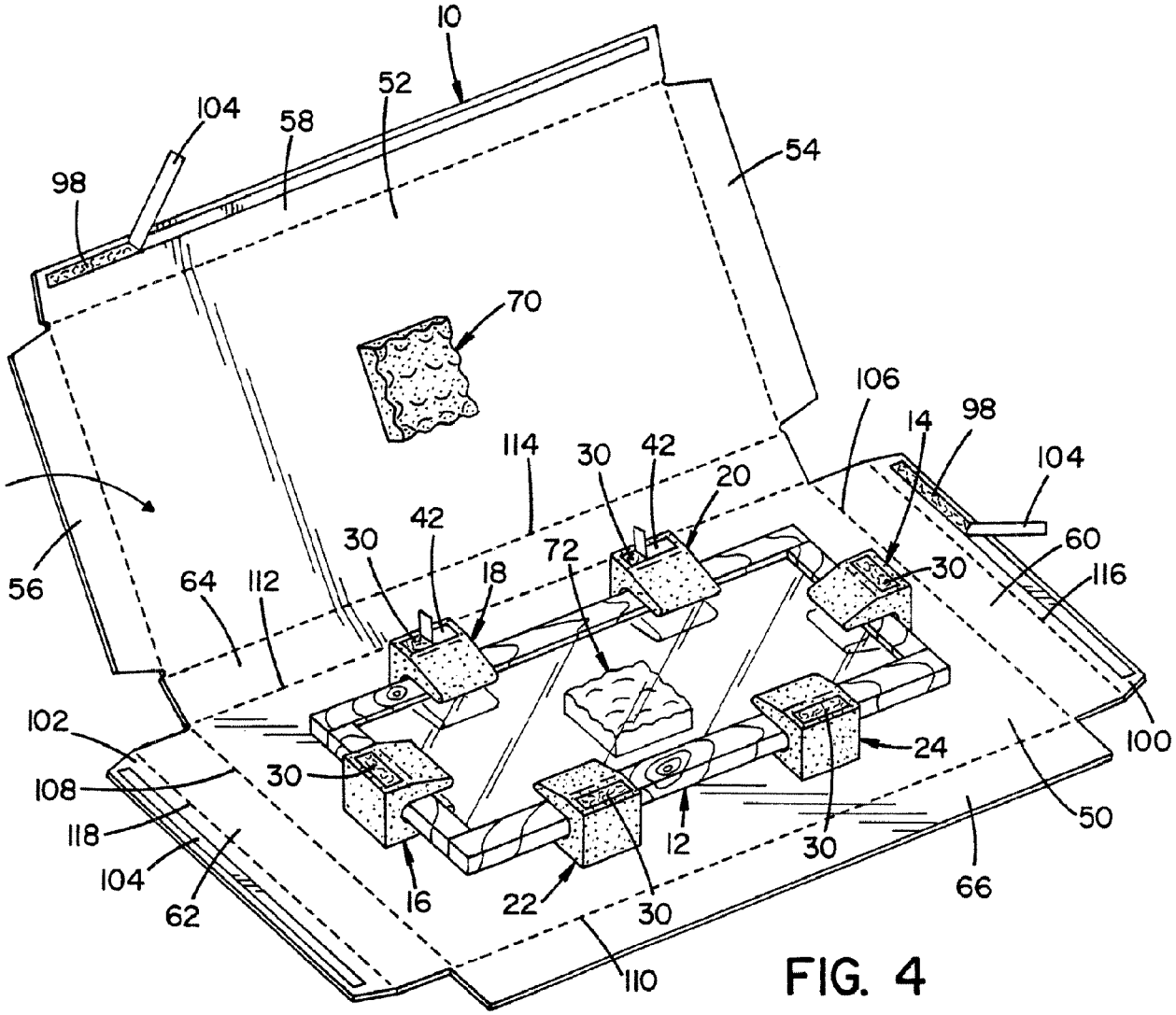
FIG. 4 is a perspective view of the shipping container of FIG. 3 showing the shipping container being closed about the product with the shock absorption members suspending the product.

With the product 12 positioned or installed on the shipping container 10, at least another or a second shock absorption member is attached to the shipping container 10 in step S206 for securing the product 12 relative to the shipping container 10. In the illustrated embodiment, with reference to FIG. 3, step S206 can include attachment of the shock absorption members 16-24 respectively to the shipping container 10 at respective locations 88,90,92,94,96 to secure the products 12 on the shipping container 10. In particular, step S206 includes positioning each of the shock absorption members 16-24 on the shipping container 10 such that the product 12 is received within slots 40 defined in each of the shock absorption members 16-24. As best shown in FIG. 3, when the product 12 is installed onto the shipping container 10 and secured thereto by the additional shock absorption members 16-24, an underside of the product 12 rests against the foam pad 72. If desired, the locations 80 and 84-96 can be marked on the shipping container 10 by appropriate indicia as shown in the illustrated embodiment or other markings could be used (e.g., scoring).

Figure 9:
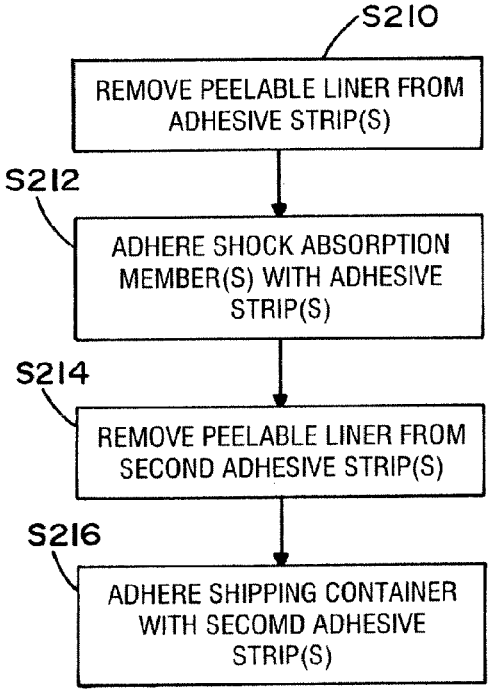
FIG. 9 is a block diagram illustrating further steps of the packaging method of FIG. 8.

The steps S202 and S206 of attaching the shock absorption members 14-24 to the shipping container 10 can include removing the peelable liners 42 from the adhesive strips 26,30 of the shock absorption members 14-24 and adhering each of the shock absorption members 14-24 to the shipping container 10 via the adhesive strips 26,30. Adhering each of the shock absorption members 14-24 to the shipping container 10 can include installing each member 14-24 at respective locations 80,88,90,92,94,96 on the shipping container. Specifically, as shown in FIG. 9, the removable liner 42 of the lower adhesive strip 26 can be removed (S210) and the shock absorption member 14 can be adhered to the shipping container at location 80 as shown in FIG. 1 (S212). If the foam pads 70,72 are used, peelable liner 42 on adhesive strip 82 of the foam pads 70,72 can be removed and the foam pads 70,72 adhered to the shipping container 10 at respective locations 84,86. This results in foam pad 72 being disposed (or interposed) between an underside of the cabinet 12 and the first main section 50 of the shipping container 10. These same steps S210, S212 can be performed when attaching the shock absorption members 16-24 to the shipping container 10 at locations 88-96, as shown in FIG. 3.

Similarly, before closing the shipping container 10 about the product 12, peelable liners 42 can be removed from the second adhesive strips 30 disposed on the second sides 32 of the shock absorption members 14-24 (S214). Accordingly, when the shipping container is closed or assembled about the product 12, the shipping container 10 is adhered to the shock absorption member 14-24 via their respective adhesive strips 30 (S216). When the shipping container 10 is folded into a box about the product 12 and adhered to the shock absorption members 14-24, the foam pad 70 rests against an upper surface of the product 12 and is interposed between the product 12 and the second main section 52 of the shipping container 10 forming the second side of the shipping container 10.

Closing the shipping container 10 in step S208 includes folding the shipping container 10 into a box about the product 12 with an inner surface of a first side (i.e., first main section 50) adhered to respective first sides 28 of the shock absorption members 14-24 and inner side of the second side of the box 10 (i.e., second main section 52) adhered to respective second sides 32 of the shock absorption members 16-24. Advantageously, the shipping container 10 includes at least one adhesive strip disposed thereon that adheres to another portion of the shipping container to maintain the shipping container in its box form. This allows the shipping container 10 and the packaging system and method disclosed herein to be used without further adhering products, such as glue, tape, etc.

In particular, adhesive strips 98 can be provided or disposed on the shipping container 10, particularly along side tab 58 and end flaps 100,102 of the end tabs 60,62 respectively. Peelable liners 104 can be provided over the adhesive strips 98 for preventing inadvertent adherence of the adhesive strips to an undesired object and/or location. This shipping container 10 and the adhesive strips 98 are particularly configured and/or oriented to permit ready folding and assembly of the shipping container 10 into a box as shown in FIG. 5.

More specifically, the end flaps 60, 62 are first folded along the fold lines 106,108. Similarly, side tab 66 can be folded along folding line 110. Next the second main section 52 and the side tab 64 can be folded over about respective fold lines 112,114 with end tabs 54,56 and side tab 58 tucked inside corresponding tabs 60,62,66. The peelable liner 104 can be removed from adhesive strip 98 on side tab 58 and the adhesive strip 98 of side tab 58 can be adhered to the side tab 66. Then, peelable liner 104 can be removed from adhesive strip 98 on end flap 100; then, end flap 100 adhered via adhesive strip 98 to the second main section 52 on an outer side thereof as shown in FIG. 5. In particular, end flap 100 is folded about fold line 116.

Figure 5:
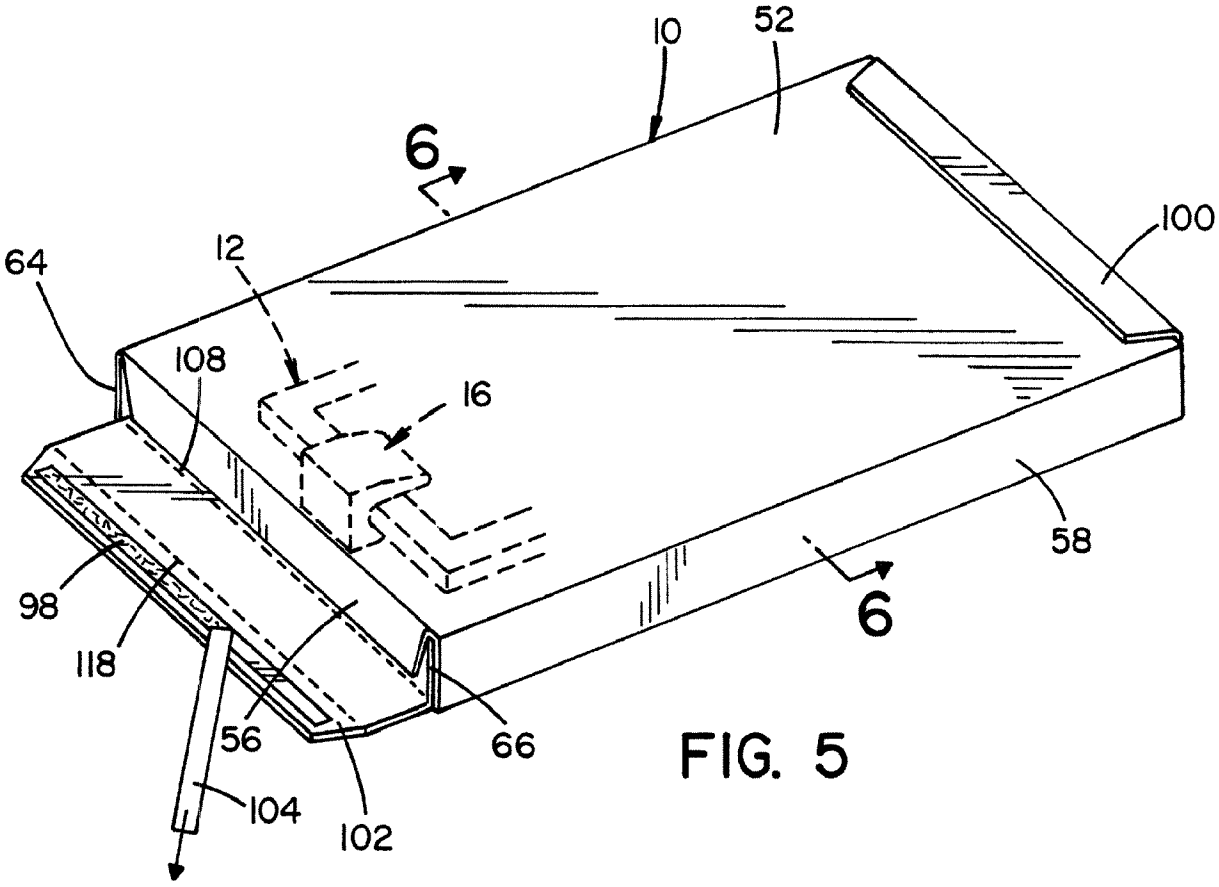
FIG. 5 is a perspective view of the shipping container of FIG. 4 shown being further closed about the product.

Similarly, as shown in FIG. 5, peelable liner 104 can be removed from the adhesive strip 98 of the end flap 102. Then, end tab 62 can be folded about fold line 108. End flap 102 can be folded about fold line 118 and secured by the adhesive strip 98 to the second main section 52 on an outside surface thereof to fully enclose the product 12 within the shipping container 10 formed as a box thereabout. As best shown in FIG. 6, the product 12 is suspended within the shipping container 10 formed as a box by the shock absorption members 16-26. As can be appreciated by those skilled in the art, the product 12 is also secured from movement within the shipping container 10. This prevents migration of the product 12 during shipping of the shipping container 10, such as toward the sides 54 or 58,66, as well as the ends, including first end 54,60 and second end 56,62. More specifically, the product 12 is secured in a central position and suspended on all sides thereof. This guards against drop damage of the shipping container 10 on all sides during shipping and handling thereof.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A packaging method for a product, comprising:

providing a shipping container appropriately sized for the product;

attaching a shock absorption member to said shipping container for serving as a locator for the product relative to said shipping container, wherein said shock absorption member is attached to said shipping container by removing a peelable liner from an adhesive strip disposed on said shock absorption members, adhering said shock absorption member to said shipping container via said adhesive strip;

positioning the product on said shipping container with said shock absorption member;

attaching another shock absorption member to said shipping container to secure the product on said shipping container, wherein said another shock absorption member is attached to said shipping container by removing a peelable liner from an adhesive strip disposed on said another absorption members adhering said another shock absorption member to said shipping container via said adhesive strip;

removing a peelable liner from a second adhesive strip disposed on each of said shock absorption member and said another shock absorption member, said second adhesive strip disposed on an opposite side of each of said shock absorption member and said another shock absorption member relative to said first adhesive strips; and closing said shipping container about the product with said shock absorption member and said another shock absorption member suspending the product within said closed shipping container, wherein said shipping container is adhered to each of said shock absorption member and said another shock absorption member via said second adhesive strips during said closing of said shipping container about the product.

2. The method of claim 1, wherein positioning the product on said shipping container includes inserting the product into a slot defined by said at least one shock absorption member.

3. The method of claim 2, wherein attaching said another shock absorption member includes positioning said another shock absorption member on said shipping container such that the product is received within a slot defined in said another shock absorption member.

4. The method of claim 1, wherein said shipping container is a foldable box and said product is one of a door, a door with a glass portion, a mirror or a framed piece.

5. The packaging method of claim 1, wherein said at least one shock absorption member is a first clip, and said another shock absorption member is a second clip.

6. The packaging method of claim 1, wherein closing said shipping container about the product includes folding the shipping container into a box about the product.

7. The packaging method of claim 5. wherein positioning the product includes having the product received within slots defined by each of said first and second clips.

8. A packaging method for a product, comprising:

providing a shipping container appropriately sized for the product;

attaching a shock absorption member to said shipping container for serving as a locator for the product relative to said shipping container;

positioning the product on said shipping container with said shock absorption member;

attaching another shock absorption member to said shipping container to secure the product on said shipping container; and closing said shipping container about the product with said shock absorption member and said another shock absorption member suspending the product within said closed shipping container, wherein each of said shock absorption member and said another shock absorption member has a first side with a first adhesive strip and a second opposite side with a second adhesive strip.

9. A packaging method for a product, comprising:

providing a shipping container appropriately sized for the product;

attaching a shock absorption member to said shipping container for serving as a locator for the product relative to said shipping container;

positioning the product on said shipping container with said shock absorption member;

attaching another shock absorption member to said shipping container to secure the product on said shipping container; and closing said shipping container about the product with said shock absorption member and said another shock absorption member suspending the product within said closed shipping container, wherein said closing of said shipping container includes folding said shipping container into a box about the product with an inner surface of a first side of said box adhered to a first side of each of said shock absorption member and said another shock absorption member, and an inner side of a second side of said box adhered to a second side of each of said shock absorption member and said another shock absorption member.

10. The method of claim 9, including inserting a foam pad between at least one of said first side and said second side of said box and the product carried within said box.

11. The method of claim 9, wherein said shipping container includes at least one adhesive strip disposed thereon that adheres to another portion of said shipping container to maintain said shipping container as said box.

* * * * *